United States Patent [19]

Yoshida

[11] Patent Number: 4,592,504

[45] Date of Patent: Jun. 3, 1986

[54] HOT-WATER STORAGE TYPE HOT-WATER SUPPLY APPARATUS OPERATING UNDER A NATURAL CIRCULATION PRINCIPLE

[75] Inventor: Tadashi Yoshida, Nakatsugawa, Japan

[73] Assignee: Mitsubishi Denki Kabushiki Kaisha, Tokyo, Japan

[21] Appl. No.: 233,615

[22] Filed: Feb. 3, 1981

[51] Int. Cl.[4] ..... F22B 1/02

[52] U.S. Cl. ..... 237/19; 122/13 R; 122/367 C; 122/32; 236/34.5

[58] Field of Search ..... 237/19; 122/13 R, 16, 122/367 C; 236/34.5

[56] References Cited

U.S. PATENT DOCUMENTS

| | | | |
|---|---|---|---|
| 2,029,574 | 2/1936 | Knudsen | 237/19 R |
| 2,201,406 | 5/1940 | Miller | 237/19 R |
| 3,574,302 | 4/1971 | Csathy | 122/367 C |
| 4,165,735 | 8/1979 | Smith | 126/434 |
| 4,222,350 | 9/1980 | Pompei et al. | 122/367 C |
| 4,245,782 | 1/1981 | Brown | 236/34.5 |
| 4,248,374 | 2/1981 | Sliger | 236/34.5 |
| 4,257,553 | 3/1981 | Sliger | 236/34.5 |

FOREIGN PATENT DOCUMENTS

| | | | |
|---|---|---|---|
| 52-6847 | 1/1977 | Japan . | |
| 52-158951 | 12/1977 | Japan . | |
| 290359 | 6/1965 | Netherlands | 239/19 R |

*Primary Examiner*—Henry C. Yuen

*Attorney, Agent, or Firm*—Wenderoth, Lind & Ponack

[57] ABSTRACT

A hot-water storage type hot-water supply apparatus operates under a natural circulation principle wherein hot-water is accumulated within a hot-water tank by circulating cold water or hot-water contained therein through a first circulation pipe connected to the bottom thereof, a heat exchanger, and a second circulation pipe. A thermal valve is mounted in the second circulation pipe downstream of the heat exchanger such that its opening area is varied depending upon the hot-water temperature in the second circulation pipe so as to maintain the temperature of the hot-water flowing out of the heat exchanger at a substantially constant temperature, resulting in the temperature distribution of the hot-water within the tank at the time of its boiling being kept substantially constant throughout the storage tank instantaneously at the start of the boiling of the hot-water.

3 Claims, 9 Drawing Figures

HOT-WATER STORAGE TYPE HOT-WATER SUPPLY APPARATUS OPERATING UNDER A NATURAL CIRCULATION PRINCIPLE

TECHNICAL FIELD OF THE INVENTION

The present invention relates to an improvement in a hot-water storage type hot-water supply apparatus operating under a natural circulation principle.

BACKGROUND ART

Now a hitherto known hot-water storage type hot-water supply apparatus operating under the natural circulation principle will be explained with reference to FIG. 1 of the attached drawings. As shown in the drawing, water contained within a hot-water storage tank (3) provided with a water feed orifice (1) and a hot-water supply orifice (2) is fed through a first circulation pipe (4) connected to the bottom of tank (3) to a heat exchanger (5) to be heated by a burner or a combustor (6), the water thus heated being supplied through a second circulation pipe (7) to the upper portion within tank (3).

In this case, assuming that the mean density of water flowing through first circulation pipe (4) is $\bar{r}_1$, the mean density of hot-water flowing through second circulation pipe (7) is $\bar{r}_2$, and the height from the middle position of heat exchanger (5) to the boundary surface between the hot-water and the cold-water within hot-water storage tank (3) is $H_1$, the natural circulation force F is formulated as follows:

$$F=(\bar{r}_1-\bar{r}_2)\cdot H_1 \quad (1)$$

It has also been known that the flow rate w of the cold- or hot-water passing through a circulation passage A comprising first circulation pipe (4), heat exchanger (5) and second circulation pipe (7) is related to the natural circulation force F by the following equation:

$$w \propto F^n (n \geqq 1) \quad (2)$$

Further, assuming that the heat quantity given to the water in heat exchanger (5) by the heat from combustor (6) is Q, the specific heat at constant pressure is $C_p$, and each of the temperatures of the cold- and hot-water at the entrance and the exit of heat exchanger (5) are Tin and Tout, respectively, the next equation is given:

$$w=Q/C_p\,(Tout-Tin) \quad (3)$$

Therefore, the equations (2) and (3) become as follows:

$$1/(Tout-Tin) \propto F^n \quad (4)$$

Thus, it will be appreciated that the smaller the natural circulation force F, the larger the temperature difference (Tout−Tin) becomes.

In short, as shown in FIG. 1, if the hot-water accumulates as high within hot-water storage tank (3) as a level denoted by the dot-and-dash line $B_1$, height H decreases to as low as $H_1$, while $(\bar{r}_1-\bar{r}_2)$ increases a bit, but, since the degree of decrease in H is larger than the degree of increase in $(\bar{r}_1-\bar{r}_2)$, the natural circulation force F as represented by formula (1) decreases so that the temperature difference (Tout−Tin) in the temperature of the water before and after the heat exchanger becomes large. This means that the larger the hot-water volume accumulated in the upper part of hot-water tank (3), the larger the temperature difference (Tout−Tin) becomes. From the above reasons, the temperature distribution of the hot-water in hot-water storage tank (3) of the conventional hot-water supply apparatus at the time of the boiling of the hot-water can be expressed by the diagram shown in FIG. 2, revealing a temperature gradient wherein the low temperature water exists at the bottom of the tank in the initial stage of the hot-water storage, and the higher the level of the hot-water from the bottom of tank 3, the higher the temperature of the hot-water becomes. Therefore, it has such defect that the volume of the high temperature hot-water available for practical use, i.e. the effective hot-water storage volume is less than the actual inner volume of the tank.

And, at the time of the supply of the hot-water, since, with the supply of hot-water, the circulation force F, i.e. the discharge volume from second circulation pipe (7), varies, the boundary surface between the hot-water and the cold-water varies so that the actuation and the shutting off of combustor (6) are repeated. In this case, since at the time of the actuation of the combustor the volume of the hot-water accumulated in the hot-water storage tank is small, the natural circulation force F becomes large, and the temperature of the hot-water flowing out of second circulation pipe (7) becomes low, so the temperature of the hot-water to be supplied also becomes low. Inversely, since at the time of the shutting off of the combustor the volume of the hot-water accumulated in the hot-water storage tank is large, the natural circulation force F is small, so the high temperature hot-water is supplied. Thus, as shown in FIG. 3 the variation in temperature of the hot-water at the time of its supply is large. Therefore, the conventional hot-water supply apparatus is not suited for use with, for example, a shower bath, etc.

SUMMARY OF THE INVENTION

It is an object of the present invention to eliminate such defects in the conventional hot-water supply apparatus and provide a hot-water supply apparatus in which a thermal valve is mounted to a circulation pipe downstream of a heat exchanger, which thermal valve operates such that when the temperature of the hot-water becomes high its opening area is enlarged, whereas when the temperature of the hot-water becomes low its opening area is narrowed, so that the temperature distribution of the boiled hot-water within the hot-water storage tank is kept nearly constant throughout the tank, thereby increasing the effective hot-water storage volume and eliminating the variation in temperature at the time of supplying hot-water.

BRIEF EXPLANATION OF THE DRAWINGS

FIGS. 1 to 3 show a conventional hot-water supply apparatus wherein FIG. 1 is a diagrammatical vertical sectional view of the apparatus as a whole, FIG. 2 is a diagram showing the temperature distribution in the tank at the time of the boiling of the hot-water and FIG. 3 is a diagram showing the variation in hot-water temperature at the time of its supply.

FIGS. 4 to 8 show one embodiment of a hot-water supply apparatus in accordance with the present invention in which FIG. 4 is a diagrammatical vertical sectional view of the apparatus as a whole, FIG. 5 is a vertical sectional view of the thermal valve in its closed state, FIG. 6 is a vertical sectional view of the thermal valve in its opened state, FIG. 7 is a diagram showing the temperature distribution in the tank at the time of the boiling of hot-water, and FIG. 8 is a diagram showing the variation in hot-water temperature during its supply.

DETAILED DESCRIPTION

Now the present invention will be explained fully in connection with one example with reference to the attached drawings.

Figure 1:
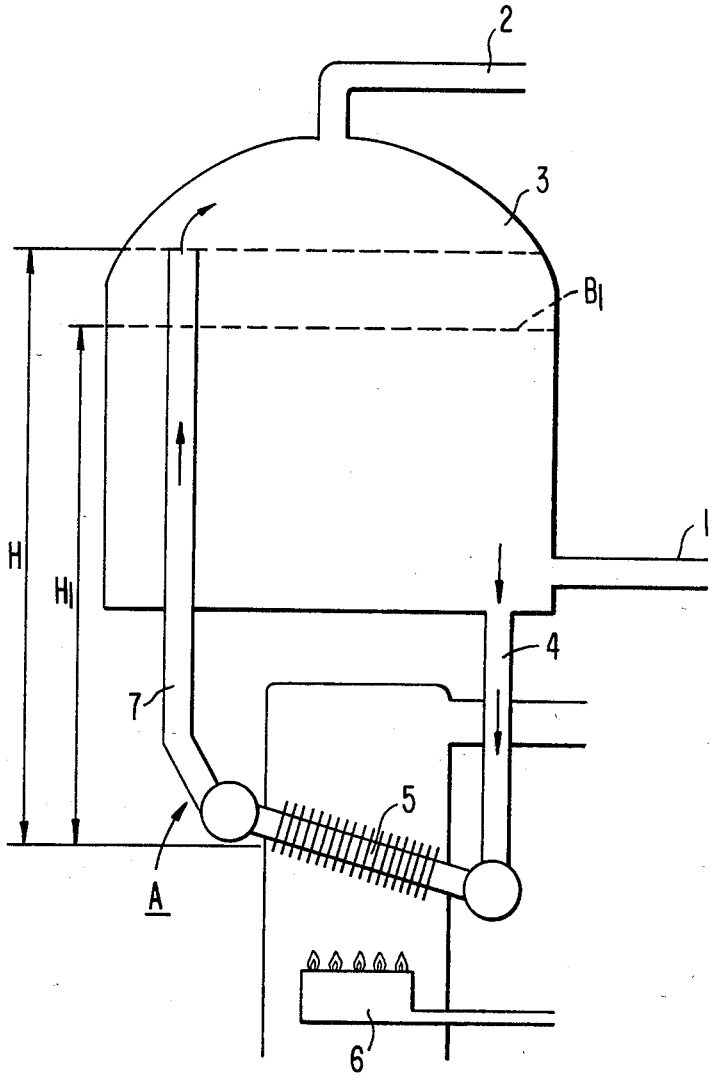
Figure 2:
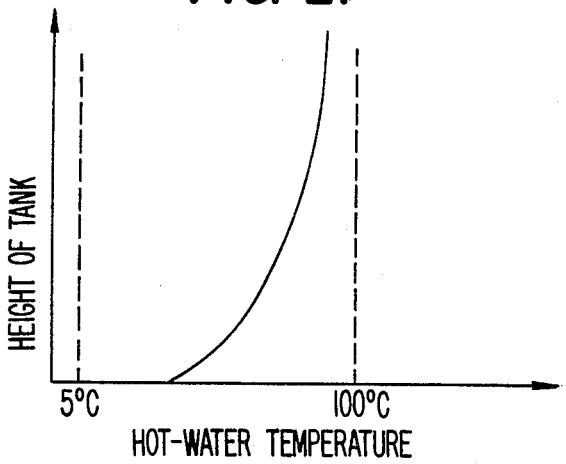
Figure 3:
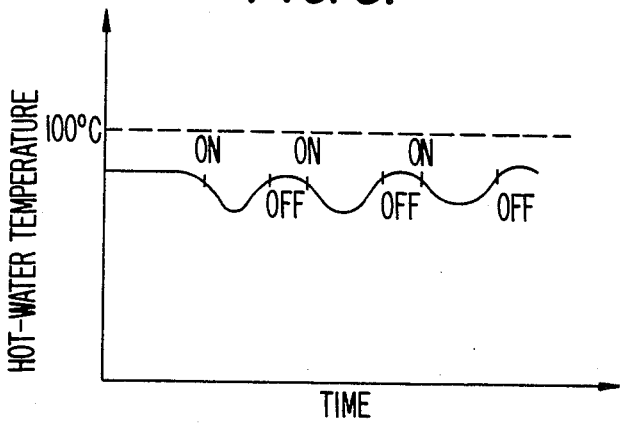
Figure 4:
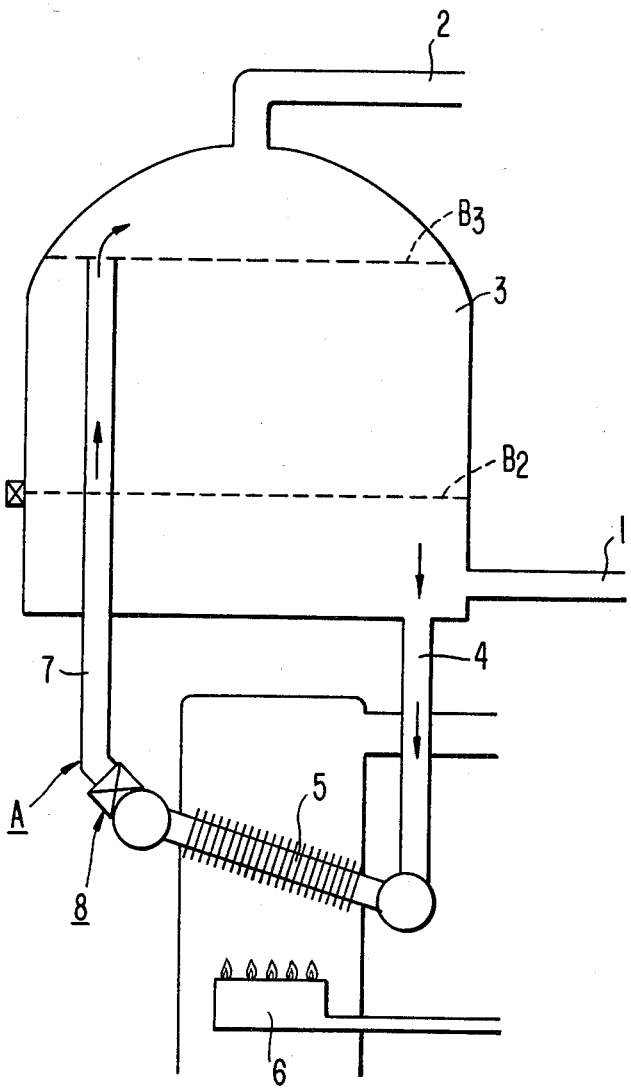

In FIG. 4, the reference numeral (1) shows a water inlet orifice, (2) a hot-water supply orifice, (3) a hot-water storage tank, (4) a first circulation pipe, (5) a heat exchanger, (6) a burner or combustor, and (7) a second circulation pipe. The present invention is characterized in the provision of a thermal valve (8) interposed in a circulation passage A at second circulation pipe (7) downstream of heat exchanger (5), thermal valve (8) operating such that when the temperature of the hot-water becomes high its opening area is enlarged and when the temperature of the hot-water becomes low its opening area is narrowed.

Figure 5:
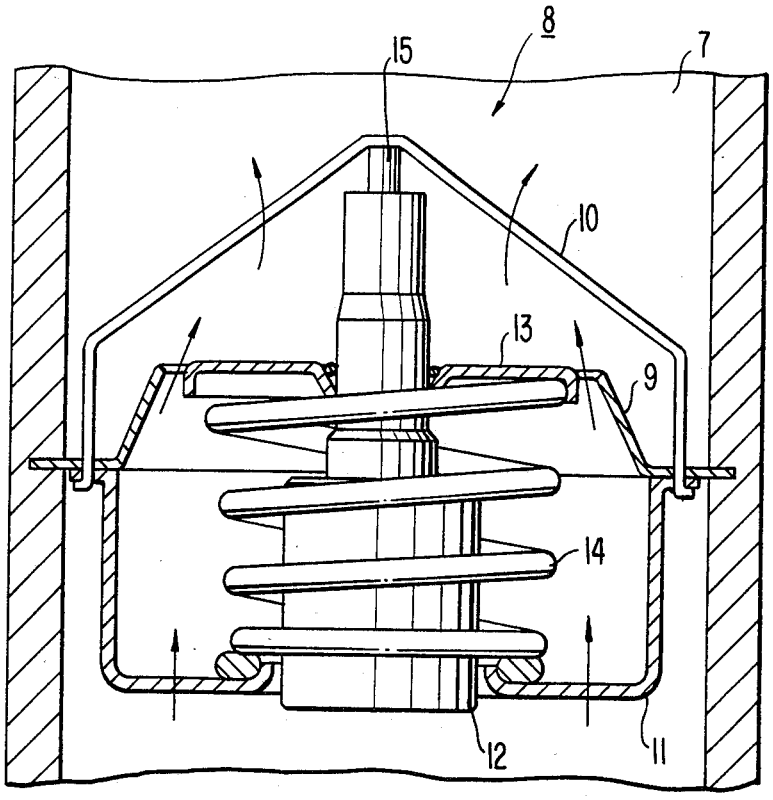

As shown in FIG. 5 thermal valve (8) comprises an orifice plate (9) fixedly mounted to the inner wall of second circulation pipe (7) near the exit of the heat exchanger and having generally a hollow truncated conical shape, a pin abutting plate (10) fixedly secured to orifice plate (9), a coil spring seating plate (11) fixedly secured to orifice plate (9), a coil spring (14) positioned on spring fixing plate (11) centrally thereof, a movable circular valve disc (13) secured to coil spring (14) at its top, a temperature feeler (12) fixedly secured to disc (13) and having thermal wax sealingly filled therein, and pin (15) protruded through temperature feeler (12) centrally thereof so as to be freely axially movable and having its upper end abutted against pin abutting plate (10).

The thermal wax sealed within temperature feeler (12) changes its state from the solid phase to the liquid phase or vice versa depending on the temperature of the hot-water, to expand or contract so that pin (15) is projected or withdrawn from or into temperature feeler (12) due to the equilibration of the force acting on movable plate (13) from spring (14) on the one hand and from temperature feeler (12) on the other hand. Therefore, in the state where the thermal wax is contracted owing to the low temperature of the surrounding hot-water, temperature feeler (12) is urged upwards relative to spring abutting plate (11) as viewed in FIG. 5 so that the area for the passage of the hot-water formed between the opening of conical-shaped orifice plate (9) and circular movable disc (13) is made small, whereby the circulation flow rate w is made small. Inversely, when the temperature of the hot-water becomes high the thermal wax expands, so movable disc (13) moves downwards against the action of spring (14) as viewed in FIG. 5 in the manner contrary to that described above. Therefore, the flow passage formed between the opening of orifice plate (9) and movable disc (13) is made large as shown in FIG. 6, whereby the circulation flow rate w is made large.

Now the operation of the hot-water supply apparatus provided with the thermal valve according to the present invention will be explained below.

Figure 6:
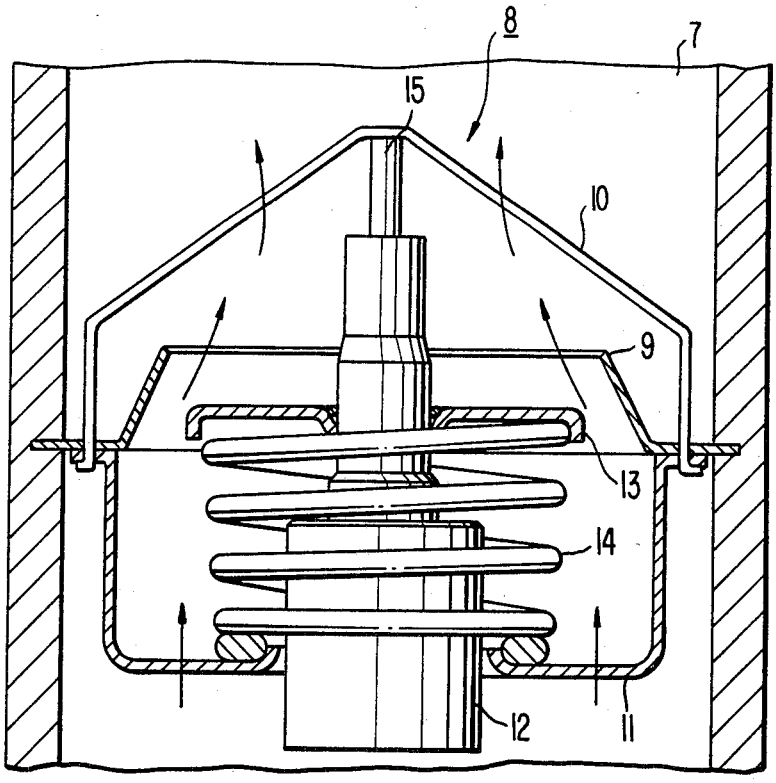

In FIGS. 4 to 6, when the apparatus is to be operated for the storage of hot-water within the storage tank, combustor (6) is ignited so that the hot-water flowing from heat exchanger (5) begins to accumulate in the upper part of hot-water tank (3) through second circulation pipe (7). At this time, in the conventional hot-water supply apparatus, if a small quantity of hot-water has been already accumulated in the upper part of tank (3), since the natural circulation force F is large, the circulation flow rate w is large so that the temperature of the hot-water at the exit of heat exchanger (5) becomes low. Contrarily, in the present invention, when the hot-water temperature at the exit of heat exchanger (5) has a tendency to be lowered, temperature feeler (12) of thermal valve (8) detects this tendency and operates so as to cause the flow area to be made small, thereby lowering the flow rate. Further, in the conventional hot-water supply apparatus, when a volume of the hot-water is accumulated within tank (3), since the natural circulation force F is small, the flow rate w is made small so that the hot-water temperature at the exit of heat exchanger (5) becomes high, but, in the present invention, when the hot-water temperature at the exit of the heat exchanger has a tendency to be increased, thermal valve (8) detects this tendency and operates to cause the flow rate of the hot-water to be increased. Therefore, in the present invention, the circulation flow rate w is maintained always substantially constant regardless of the hot-water volume accumulated within tank (3). Thus, in the present invention, hot-water temperature Tout at the exit of heat exchanger (5) is controlled so as to be substantially constant by such operation of thermal valve (8).

Figure 7:
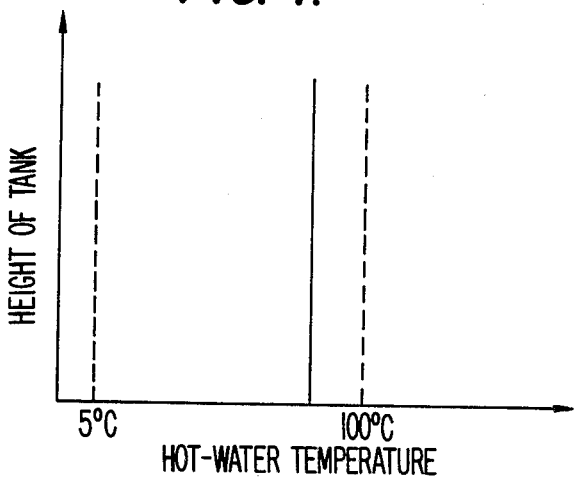

Therefore, the temperature distribution of the hot-water within the hot-water storage tank at the time of boiling is made to be substantially constant over the total height of the tank as shown in FIG. 7, resulting in the hot-water accumulation within the storage tank being as effective as possible relative to its inner volume.

Figure 8:
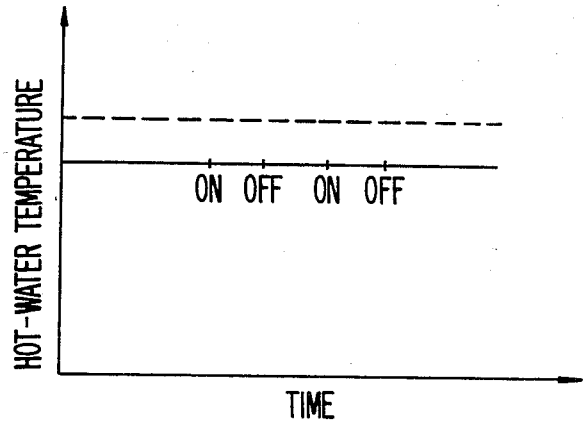

At the time of supplying hot-water in the apparatus according to the present invention, when the supply volume of the hot-water becomes less than the circulation flow rate w, even through combustor (6) repeats ignition and extinguishing, since hot-water at a substantially constant temperature is fed through second circulation pipe (7), continuous hot-water supply can be carried out while being kept at a stable temperature irrespective of whether the combustor is ignited or not, as shown in FIG. 8.

Figure 9:
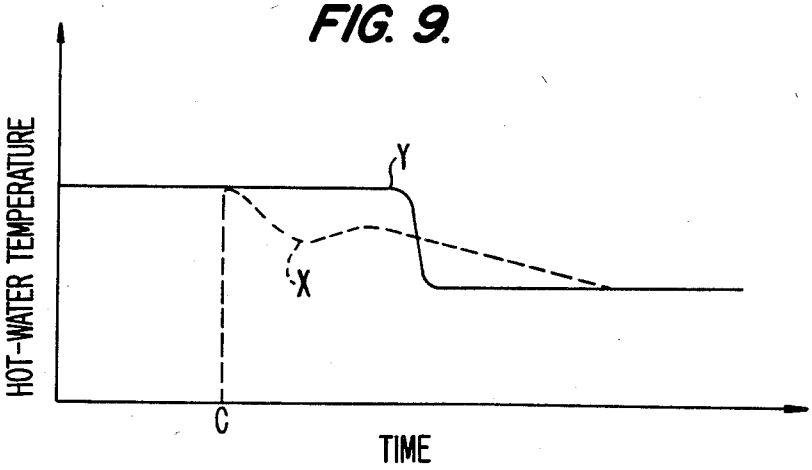
FIG. 9 is a graph showing changes in the hot-water temperature during its supply for the conventional hot-water supply apparatus and the apparatus in accordance with the present invention.

In the case where the volume of the hot-water supply is larger than the circulation flow rate w, with the assumption that combustor (6) is to be ignited when the water has been supplied to as high a level as B2 shown by the dot-and-dash line in FIG. 4 and the hot-water supply volume is W, and that the hot-water accumulation volume from level B2 to the position of the exit opening of second circulation pipe (7) (the dot-and-dash line B3) is represented by Vo and the natural circulation flow rate is represented by w, the change in hot-water temperature is shown in FIG. 9. In the conventional hot-water supply apparatus, as shown by the dot-and-dash line x, the change in hot-water temperature occurs simultaneously with the start of the ignition of the combustor (point C). Contrarily, in the hot-water supply apparatus according to the present invention, since temperature Tout of the hot-water flowing through second circulation pipe (7) by natural circulation is kept substantially constant, the hot-water supply volume becomes (W−w) in substance. Therefore, as shown by the solid line Y in FIG. 9, after the start of ignition (point C), it is possible to supply hot-water at a constant temperature for a longer period of time as formulated by the following equation:

$$Vo/(W-w)-Vo/W \quad (5)$$

This means that the present invention has an effective hot-water accumulation volume larger than the inner volume of the hot-water storage tank.

I claim:

1. A hot water storage type hot water supply apparatus operating by the principle of natural circulation, said apparatus comprising:

a hot water storage tank for storing hot water therein and from which hot water may be dispensed;

a hot water circulation passage having a first end connected to the bottom of said storage tank and a second end located at an upper position within said storage tank;

a heat exchanger disposed between said first and second ends of said passage, whereby water from said storage tank enters said first end of said passage and is heated therein by said heat exchanger, and the thus obtained hot water passes from said second end of said passage into said storage tank and is accumulated therein from an upper portion thereof to a lower portion thereof; and means for maintaining substantially constant the temperature of said hot water passing from said second end of said passage into said storage tank, said maintaining means comprising thermal valve means, positioned in said passage at a location downstream of said heat exchanger, for increasing the opening area of said passage when the temperature of said hot water becomes relatively high and for decreasing said opening area when the temperature of said hot water becomes relatively low.

2. An apparatus as claimed in claim 1, further comprising a combustor device for heating said heat exchanger.

3. An apparatus as claimed in claim 1, wherein said thermal valve means comprises a plate extending across said passage, said plate having therein an orifice, a valve member urged into said orifice to reduce the size thereof, and temperature-responsive means connected to said valve member for moving said valve member out of said orifice thereby increasing the size thereof upon an increase in temperature of said hot water in said passage.

* * * * *